United States Patent [19]

Ottestad

[11] 4,111,269

[45] Sep. 5, 1978

[54] HYDRAULICALLY-POWERED IMPACT TOOL

[76] Inventor: Jack B. Ottestad, 1442 Muirlands Dr., La Jolla, Calif. 92037

[21] Appl. No.: 620,877

[22] Filed: Oct. 8, 1975

[51] Int. Cl.[2] ..... B25D 9/14

[52] U.S. Cl. ..... 173/134; 173/162; 173/170

[58] Field of Search ..... 173/162, 134, 119, 15, 173/16, 18, 170; 16/111 R, 111 A; 91/49, 50, 224

[56] References Cited

U.S. PATENT DOCUMENTS

| | | | |
|---|---|---|---|
| 1,592,856 | 7/1926 | Jimerson | 173/18 |
| 1,868,627 | 7/1932 | Coates | 173/162 |
| 2,379,181 | 6/1945 | Pontius et al. | 251/38 X |
| 3,103,337 | 9/1963 | Forte | 251/38 X |
| 3,396,634 | 8/1968 | Butterworth | 91/224 |
| 3,411,592 | 11/1968 | Montaberh | 173/134 |
| 3,916,764 | 11/1975 | Crover | 91/235 |

*Primary Examiner*—Ernest R. Purser
*Assistant Examiner*—William F. Pate, III
*Attorney, Agent, or Firm*—Donald D. Mon

[57] ABSTRACT

A hydraulically-powered impact tool for delivering a sequence of axial blows. A body houses a gas chamber, a storage chamber, a loading chamber, and a rod passage. The gas chamber and storage chamber are separated by a movable piston, and the storage chamber and loading chamber are separated by a movable piston head that is attached to a piston rod which is reciprocably movable in the rod passage and adapted to strike a work tool. An orifice in the piston head interconnects the storage chamber and the loading chamber when the orifice is open so as to provide a short-length and large-area passage for transfer of fluid from one side of the head to the other while the tool delivers its blow. A poppet is adapted to close the orifice in one position and to leave it open in another position. A probe on the piston is adapted to move the poppet so as to open the orifice at a predetermined axial position of the piston head in order to release energy stored in the gas chamber to drive the piston rod and thereby deliver the blow to the work tool. There is also disclosed valving means for automatic and continuous operation, and a handle which facilitates the usage of the impact tool.

34 Claims, 15 Drawing Figures

10
8
8
N DIA.
M DIA.
L DIA
H DIA
G DIA
F DIA.
C DIA.

230
231
10
241
240
225
232
241a
233
10
221
215
220
250
17
18
252
45
201
253
21
20
65
66
251
205
218
216
208
200
12
206
213
P
214
68
12
207
209
13
13
211
210
212

231
241
242

231
241
242a 207
213
214
209
210
207

HYDRAULICALLY-POWERED IMPACT TOOL

This invention relates to a hydraulically-powered impact tool. Impact tools of this type are useful wherever a sharp blow is advantageous, such as in fracturing mineral deposits in mining operations, breaking pavement and concrete structures, metal forming operations, and riveting, driving and hammering. This tool can occasionally be utilized directly to exert a blow, but more frequently will serve as a means to deliver a blow to a working tool such as a bit, forge hammerhead, or spade.

Hydraulically-operated impact tools are widely known. Generally speaking, they use hydraulic power to compress a charge of gas while a piston is somehow restrained from axial movement. When a charge of energy has been loaded into the system by compressing the gas, a seal means is somehow quickly opened to enable the compressed charge of gas to drive the piston (usually through an intermediate region filled with hydraulic fluid) and deliver a blow. Examples of this type of device will be found in Ottestad U.S. Pat. Nos. 3,363,512; 3,363,513; 3,359,867; and 3,524,385. These devices have proved to be suitable in operation, but it would be useful to simplify their construction to make them lighter, more rugged, more efficient in their use of energy, automatic and continuous in operation if desired, and more comfortable for the operator to use.

It is an object of this invention to provide an impact tool in which a relatively small number of parts is required, in which the parts are simple and rugged, and in which the passages for flow of fluid are relatively short in length and large in cross-section, especially those where fluid must transfer at a rapid rate from one side of a piston head to the other while the tool delivers its blow. This device is efficient in its use of energy, is comparatively lightweight, and can function at relatively higher frequencies than devices which do not have these advantages. For example, one type of impact tool according to this invention (without the working tool) weighs only about 64 pounds, and is able to deliver blows of approximately 125 foot lbs. at rates as high as 1,000 blows per minute. Persons knowledgeable in the art will recognize this as a very substantial performance for the weight involved.

It is another object of this invention to provide simple and convenient valving means for control of supply of energy to the impact tool, and to provide a handle which facilitates the operator's work.

A hydraulically-powered impact tool according to this invention includes a body that houses a gas chamber, a storage chamber, a laading chamber, and a rod passage. The gas chamber and the storage chamber are separated by a movable piston, and the storage chamber and the loading chamber are separated by a movable piston head that is attached to a piston rod. The combination of piston head and piston rod is sometimes referred to as a "driving member". The piston rod is reciprocably movable in the rod passage. An orifice through the piston head interconnects the storage chamber and the loading chamber when the orifice is open. A poppet is adapted to close the orifice in one position and to leave it open in a second position. A probe is adapted to restrain the poppet and thereby open the orifice at a predetermined axial position of the piston head, whereby to release energy stored in the gas chamber for driving the driving member to deliver a blow, either directly to the work, or to a working tool which strikes the work.

According to a preferred but optional feature of the invention, a drain port opens into the storage chamber at a location where it will be closed by the piston head at a number of axial positions of the head along the axis.

According to yet another preferred but optional feature of the invention, valving means is provided which can cause repetitive cycling of the impact tool.

According to yet another preferred but optional feature of the invention, a springy handle is provided by means of which the operator may press against the impact tool, both to hold it and to set the valving means so the tool operates.

The above and other features of this invention will be fully understood from the following detailed description and the accompanying drawings, in which.

Figure 14:
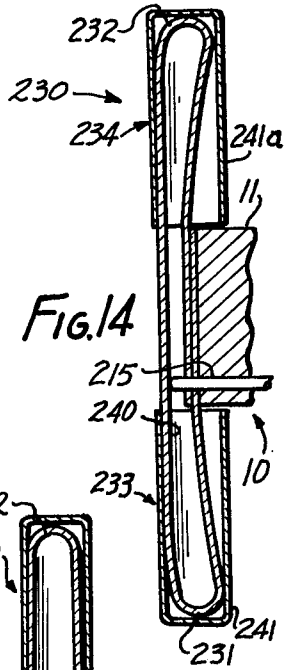
Figure 15:
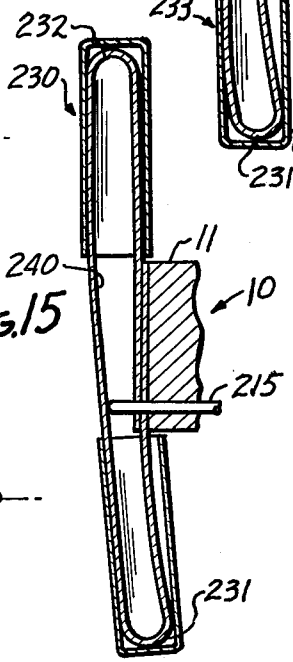
Figures 9, 10, 11, 12, 13:
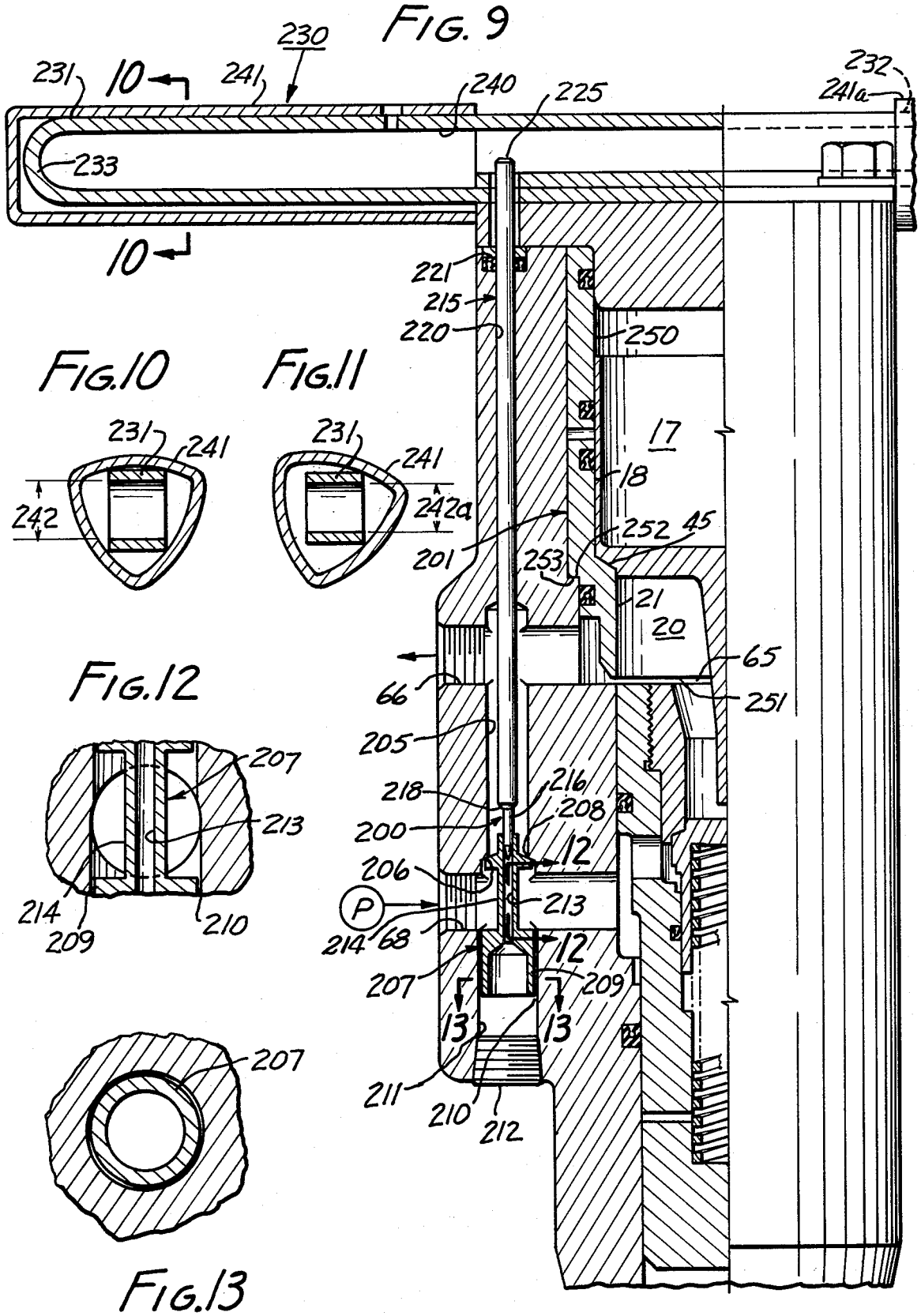
FIG. 9 is an axial half-section of the presently preferred embodiment of the invention showing the device of FIG. 1 modified to include valving means, handle means, and a preferred chamber construction.
FIG. 10 is a cross-section taken at line 10—10 in FIG. 9.
FIG. 11 is a cross-section taken at line 10—10 in FIG. 9.

FIGS. 12 and 13 are cross-sections taken at lines 12—12 and 13—13, respectively, in FIG. 9; and FIGS. 14 and 15 are fragmentary cross-sections showing two operating conditions of the handle.

Figures 1, 2, 3:
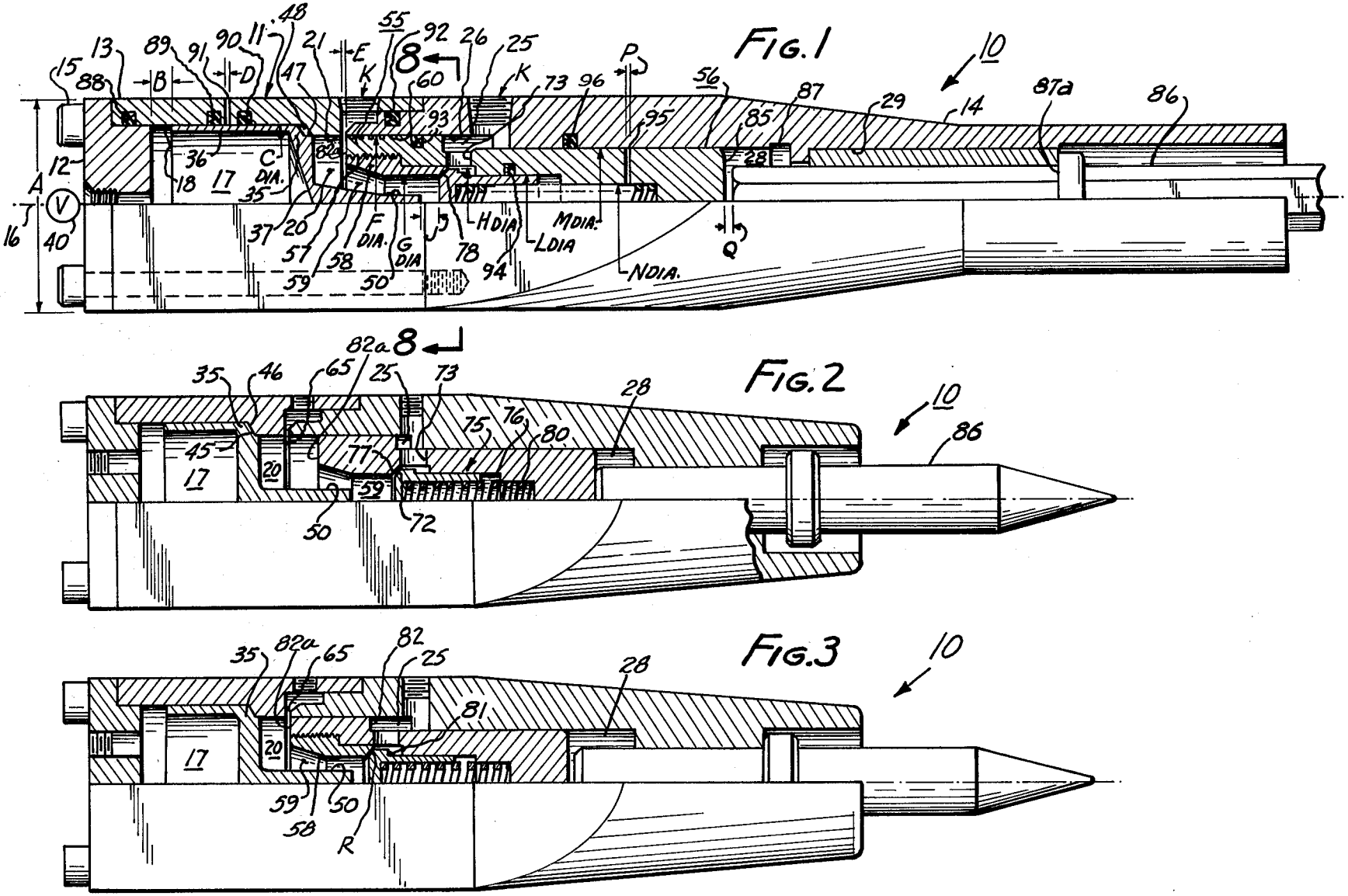
FIG. 1 is an axial cross-section of an embodiment of the invention.
FIGS. 2, 3, 4, 5 and 6 are schematic views showing the device of FIG. 1 in a sequence of operating conditions.

Referring now to FIG. 1, the impact tool 10 includes a body 11 comprising an end cap 12 and a pair of body portions 13,14 held together by tension fasteners such as bolts 15 to form a unitary construction. The tool has a central axis 16, and the body houses: a gas chamber 17 at least partially defined by a gas chamber wall 18; a storage chamber 20 partially defined by a storage chamber wall 21; and a loading chamber 25 partially defined by a loading chamber wall 26. Also, the body houses a rod passage 28 defined by a rod passage wall 29. Walls 18, 21, 26 and 29 are all circularly cylindrical and are all coaxial on central axis 16.

An axially movable piston 35 makes a fluid-sealing, sliding fit with gas chamber wall 18. It comprises a peripheral cuplike wall 36 and a face 37. The gas chamber is thereby defined by the movable piston, the gas chamber wall and the end cap. Its volume is variable, depending on the axial location of the piston. Suitable valve means 40 is provided for the insertion ("charging") of gas under pressure, usually nitrogen, into the gas chamber. This gas biases piston 35 to the right in FIG. 1.

A stop 45 (FIG. 2) is formed between the gas chamber and the storage chamber. It is formed as a tapered shoulder and limits the excursion of the piston to the right, i.e., toward the rod passage in FIG. 1. A matching tapered shoulder 46 and an overhanging skirt 47 on the piston partially bound a braking chamber 48 which serves to decelerate the piston as it nears its right-hand position in FIG. 1. There is a small radial clearance between storage chamber wall 21 and the skirt, which will enable fluid to be expelled from the braking chamber while shoulder 46 approaches stop 45. The work necessary to expel the fluid from the braking chamber decelerates the piston.

The piston carries a probe 50 which projects toward the rod passage.

An axially movable piston head 55 is carried by a piston rod 56. The piston head makes a sliding, fluid-sealing fit with the loading chamber wall and with the storage chamber wall. Walls 21 and 26 are continuations of the same surface. The piston head divides the chambers from one another, and has a face in each of them, namely a driving face 82*a* facing into the storage chamber and a loading face 82 facing into the loading chamber. The volumes of these chambers are inversely related, growth of one being accompanied by shrinking of the other. The head may be formed integrally with the piston rod for convenience in construction and maintenance, and usually will be, although it could instead be made of a separate part and attached to the piston rod. The combination of piston head 55 and piston rod 56 is sometimes called a "driving member". The driving member has an internal thread 57 to receive an orifice member 58 with a central orifice 59 therein. Grooves 60 are provided to resist seepage between the piston and walls 21 and 26.

Especial attention is called to the facts that: the orifice 59 constitutes a passage which passes through the piston head in the sense that it interconnects opposite faces of the piston head when the orifice is open; that it is relatively short in length; and that its cross-section is quite large. The importance of these features will further be discussed below.

A drain port 65 (FIG. 2) is formed as a peripheral slit in the wall of the storage chamber. It is so disposed and arranged that it will be closed by the wall of the piston head in the range of piston head positions to the left of that position which is shown in FIG. 1, for example in the positions of FIGS. 4 and 5. It is not closed at the piston head position of FIG. 1, and to the right thereof. Drain port 65 communicates with drain fitting 66 (FIG. 4) for attachment to a hose that returns to tank 67. A supply port 68 passes through the body from a supply fitting 69 and connects to the loading chamber. Hydraulic liquid under pressure is supplied from the tank via a pump 69*a*. An on-off valve 70 is provided to enable or to prevent flow of hydraulic fluid to the supply port.

Figure 8:
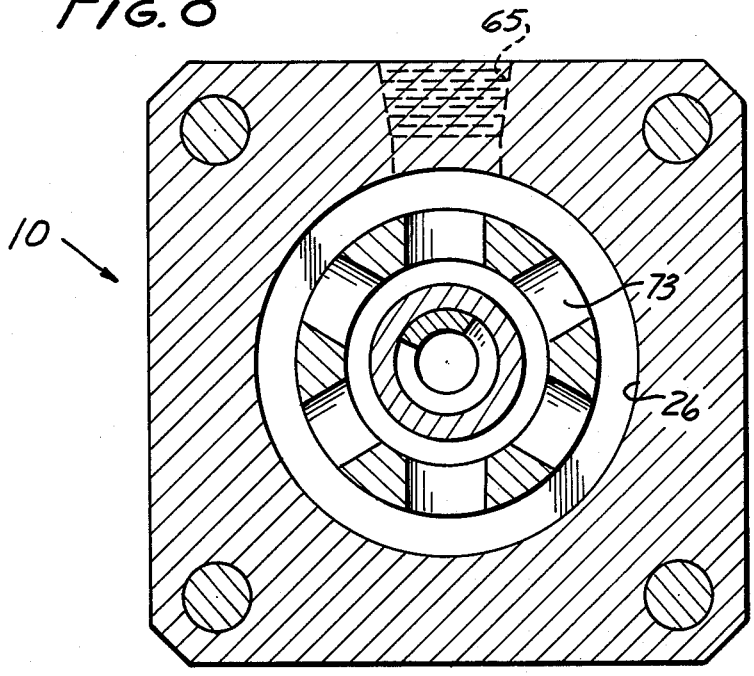
FIG. 8 is a cross-section taken at line 8—8 in FIG. 1.

The orifice member (FIG. 2) includes a valve seat 72 which faces toward the piston rod. It is conveniently made frustoconical a plurality of dump ports 73 radiate inwardly from the loading chamber to the orifice as best shown in FIG. 8. It is important to observe that the total cross-section of the dump ports is comparatively large, preferably being as great as or greater than the cross-section area of the orifice. Therefore, they and orifice 59 combine to form a large cross-section, relatively short-path-length passage between chambers 20 and 25.

A poppet 75 is axially fitted in a cavity 76 in the piston rod. It includes a peripheral valve seal 77 which is frustoconical and of such an angle relative to the angle of valve seat 72 that it makes a peripheral seal at a ring-like location indicated by the letter "R" (FIG. 3) near the outer edge of the valve seat and the valve seal. There is a clearance between the valve seat and valve seal radially inward from "R" when the poppet bears against the seat. The valve seat and valve seal comprise a "poppet valve".

In the illustrated first position of the poppet in FIG. 1, the poppet closes the orifice and prevents flow between loading chamber 25 and storage chamber 20. In a second position of the poppet, where it is spaced from the seat, those two chambers will be interconnected to one another. A bias spring 80, comprising a coil located in the cavity, constitutes "bias means" which biases the poppet toward the said first position. This force is mechanical, and is independent of pressure in the system.

The poppet includes a bias holding face 81 which faces toward the piston rod. The piston includes a loading face 82 which also faces toward the piston rod. Under certain pressure conditions, pressure on holding face 81 functions to hold the poppet against the valve seat under certain conditions.

The piston rod has a striker face 85 which strikes a work tool 86, perhaps a chisel, when the driving member is driven. Of course, the piston rod itself can be used for the work tool and could do the work directly. However, a tool which actually strikes the work wears rapidly, and it is simpler to replace an individual tool then to remove and replace the piston rod.

The work tool is reciprocably mounted in the body. A bayonet coupling 87, or other conventional means, removably connects the tool to the body. This is a conventional assembly technique. It permits the work tool to move axially within limits, but not to fall out. A shoulder 87*a* limits the movement of the work tool toward the driving member.

Seal means is provided to seal the various chambers. Seal 88 seals between the body and the end cap. Ring seals 89, 90 seal against the piston. A vent port 91 vents the region between these seals. Seal 92 seals between the two body portions. Seal 93 forms a sliding seal between the piston head and the wall of the loading chamber and storage chamber. Seal 94 makes a sliding seal between the poppet and the cavity in the piston rod.

A vent 95 assures that fluid in the cavity cannot "lock" the poppet in its extended (or any other) position. A seal 96 seals between the piston rod and the body. The type of seal for each location will be selected for best function. Usually they will be spring-loaded, chevron-type seals. Fluid drained from vent 95 flows out of the impact tool along the rod passage and past the work tool 86.

Figure 6:
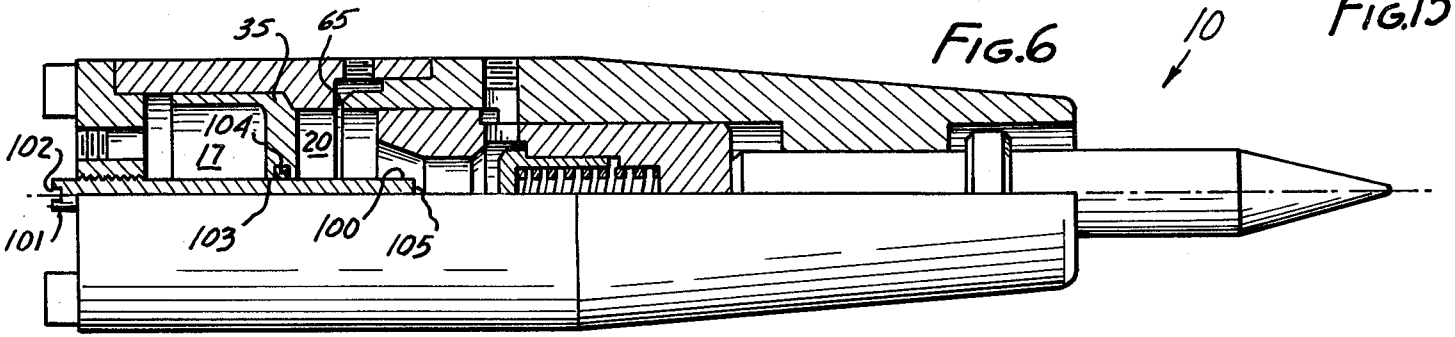
Figure 7:
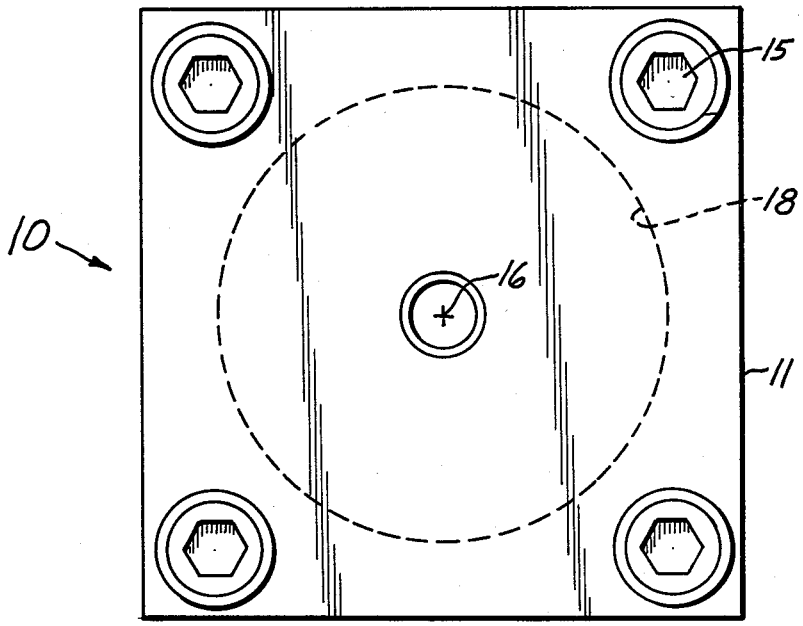
FIG. 7 is a left-hand end view of FIG. 1.

In FIG. 6 there is shown an alternte embodiment for the probe. In this embodiment, a probe 100 is threaded to the end cap and passes through it. It has an end 101 outside the end cap. The probe is adapted, such as by means of a screw slot 102, to be turned, and the axial location of its tip end can be adjustably selected. The probe is circularly cylindrical and passes through a passage 103 extending through piston 35, with which it makes a sliding, fluid seal. Ring seal 104 makes the sealing fit. Piston 35 is slidable along the probe. The probe tip 105 is placed at a precise and adjustable distance from the end cap so as to unseat the poppet at an adjustable and predetermined location in the body, thereby to adjust the length of the stroke of the driving member.

FIG. 9 shows two features which, in combination with the device of FIG. 1, comprise the presently preferred embodiment of the invention. The first of these features is a valving system 200 that provides for automatic cycling of the impact tool. The other is an insert 201 that forms the wall of gas chamber 17, part of the wall of storage chamber 20, and one wall of drain port 65. Identical numbers are used for functionally identical parts in FIGS. 1 and 9.

Figure 4:
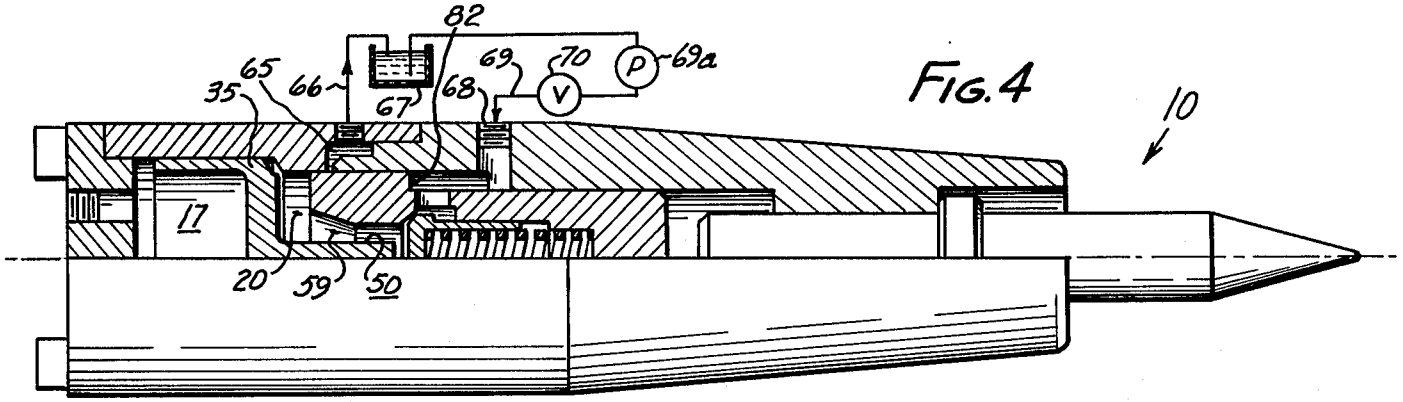

The valving system 200 (FIG. 9) is used in place of valve 70 (FIG. 4). A bypass passage 205 interconnects supply port 68 and drain port 65 at drain fitting 66. A valve seat 206 in the bypass passage faces pressure in the supply port.

A valve shuttle 207 has a valve seal 208 proportioned to seat on valve seat 206 and close it. It also includes a piston 209 that fits with a clearance 210 in cylinder 211 that is closed by a plug 212. A bleed passage 213 passes through a reduced stem 214 on the shuttle from the end of the piston in cylinder 211. The valve shuttle is therefore movable axially in the cylinder and bypass passage, and is shuttled by hydraulic pressure, the position depending on the location of a trigger pin 215.

Trigger pin 215 has a cylindrical point 216 proportioned to fit and slide in bleed passage 213 when pressed downward to fit into it. The cylindrical point makes a "trombone" seal in the bleed passage when it is in the bleed passage. It includes a bias face 218 on its periphery within the bypass passage.

There are two areas which, when pressure is applied to them, tend to move the trigger pin upwardly so as to remove it from the valve shuttle. The first is the area of the tip of the cylindrical point. When the valve is closed, and fluid under pressure is supplied to port 68, this high pressure on the tip tends to boost the tip out of bleed passage 213. As will later be shown, this occurs unless the trigger pin is held down where it will close the bleed port. The other area is bias face 218. When the bleed passage is open, the valve shuttle moves off the valve seat, and fluid flows through bypass passage 205. The pressure in passage 205 is higher than drain pressure, and is sufficient to hold the trigger pin up to keep the valve open until the trigger pin is pressed down against this force to close the bleed passage.

A passage 220 through the body carries a peripheral seal 221 that holds the trigger pin with a sliding fluid-sealing fit. Abutment surface 225 at the top end of the trigger pin is located outside of the body where it can be contacted and pushed down to start the operation of the impact tool. Pushing the trigger pin down causes point 216 to close the bleed passage. The resulting differential force on the valve shuttle moves it upward to close the bypass passage at seat 206, and full pressure is thereby applied to the loading chamber. The shuttle slides along the cylindrical point to make the closure.

A handle assembly 230 (FIGS. 9, 14 and 15) is a doubly folded strap of flat flexible material, preferably steel. A pair of U-shaped bends 231, 232 form individual handles 233, 234 (FIG. 14). The free ends of the bends are bolted to the body. The handles project laterally beyond the body. The relaxed configuration of the handle is shown in FIG. 9 wherein the impact tool is not operated. FIGS. 14 and 15 show distorted configurations where it is operated.

In FIG. 9 the trigger pin and the valve shuttle are shown in arbitrary positions, with the hydraulic pressure shut off. The trigger pin and shuttle are in the position which they would assume if the cross-member 240 of the handle were pressed down against abutment surface 225.

Sleeves 241, **241*a* surround respective handles 233, 234. They have a triangular shape which is comfortable to the grip (FIGS. 10 and 11). When the sleeves are in the rotational position shown in FIG. 10, a normal spacing 242 exists within the handle end, and unless one or both of the handles is pressed down, hydraulic pressure on bias face 218 will move the trigger pin upward, the valve will be open, and the impact tool will not run. If the handle is pressed down, the trigger pin is moved so its cylindrical point closes bleed passage 213**, the shuttle valve will close, and the tool will run.

If it is desired to have the tool run without holding the handle down, the sleeves can be turned as in FIG. 11, shortening the distance 242 to distance **242*a***, which is enough to depress the trigger pin and run the tool.

FIG. 14 shows both handles pressed down. Their lower reaches flex, and cross-member 240 moves straight down. FIG. 15 shows that only one of the handles need be deflected in order to depress the trigger pin. These FIGS. also illustrate the fact that the pin can be kept pressed down by a force sufficient to keep the tip in the bleed passage. Because there is a substantial range of axial locations where this occurs, considerable relative movement is possible between the handle tips and the tool. Therefore, the handles constitute a springy interlinkage between the operator and the impact tool, which makes the use of the tool much more comfortable and convenient. This handle is useful with impact tools generally, and not merely with the illustrated tool, or merely with the illustrated valving.

The impact tool needs to be made to relatively close tolerances, and some of the inside parts as shown in FIG. 1 are relatively difficult to hold to these tolerances. The insert 201 (FIG. 9) overcomes many manufacturing problems. It fits in a bore 250 and carries gas chamber wall 18, part of storage chamber wall 21, one edge 251 of drain port 65, and stop 45. It is sealed to the wall of bore 250, and its position is determined by the abutment of shoulders 252, 253. This sleeve can readily be made as a small part to close tolerances, which makes an important contribution to the economy and producibility of the impact tool.

The operation of the device should be understood from the foregoing, but will briefly be recounted with reference to the simplified FIGS. 2–6, which show sequential operating positions. The illustrated device may advantageously be charged with gas, such as nitrogen, at approximately 600 psi and powered with hydraulic fluid at 2,000 psi. These pressures are quite suitable for this device, and it can operate at rates as high as 1,000 blows per minute, delivering approximately 125 foot lbs. of energy per blow. This is for a device with the dimensions given below. Different operating speeds and energy outputs can be provided by varying the size of the actuator and of its supply means. It is a considerable advantage of this design that it can readily be scaled to other sized and outputs.

FIG. 1 shows the device in an arbitrary position for purposes of dimensional disclosure. It will be understood that the drawings are not precisely to scale, and therefore the drawings are semi-schematic in showing the relative positions of parts of the actuator during operation.

FIG. 2 shows the device in repose, either just after the last blow was delivered, or just before loading the device to deliver the next blow. Piston 35 is entirely to the right, bearing against stop 45. Valve 70 may even be turned off. The poppet bias spring will have moved the poppet to its closed position, and the device awaits actuation. It may be assumed that those portions of the device which operate with hydraulic fluid are already filled with such fluid. If not, when valve 70 is first opened, the device will deliver a few shortened and inefficient cycles until it becomes completely filled with fluid. Thereafter it will operate with full efficiency and power.

At the position of FIG. 3, valve 70 is open, and hydraulic fluid under pressure is flowing into loading chamber 25. Because the piston head is to the right of drain port 65 in FIG. 1, the drain port is open and connects storage chamber 20 to drain. Therefore, the storage chamber will be at drain pressure in the position of FIG. 3. A differential pressure is exerted on the holding face 81 (in addition to the spring force) to hold the poppet in its first position and orifice 59 is closed. A net force to the left will therefore be exerted on the annular loading face 82, tending to move the piston head and piston rod to the left in FIG. 3. The piston head will move past the position of FIG. 3. FIG. 3 shows the piston head about to close drain port 65, and closure will occur after a short additional movement to the left. Then conditions begin to change, because now displacement of the piston head to the left displaces liquid to the left in the storage chamber. Fluid can no longer escape from the drain port because port 65 is closed. Piston 35 is now moved to the left, and this movement compresses the gas in gas chamber 17, and raises its pressure. This stores energy in the gas chamber.

The combination of the bias spring force and the net force on the holding face 81 will cause the poppet to remain closed during this movement. This is because the seal "R" is located near the outer edge of the poppet, and holding face 81 extends inwardly relative to "R". Continued movement of the driving member, as shown in FIG. 4, causes the poppet to approach the tip of the probe. Until this occurs, the device is in stable condition, the popper remaining closed. The influx of hydraulic fluid into the loading chamber continues to move the piston head to cause increasing compression of the gas in the gas chamber. Although both piston 35 and the driving member move to the left, the piston head moves faster than piston 35, so it catches up with the probe because of the different areas involved.

Figure 5:
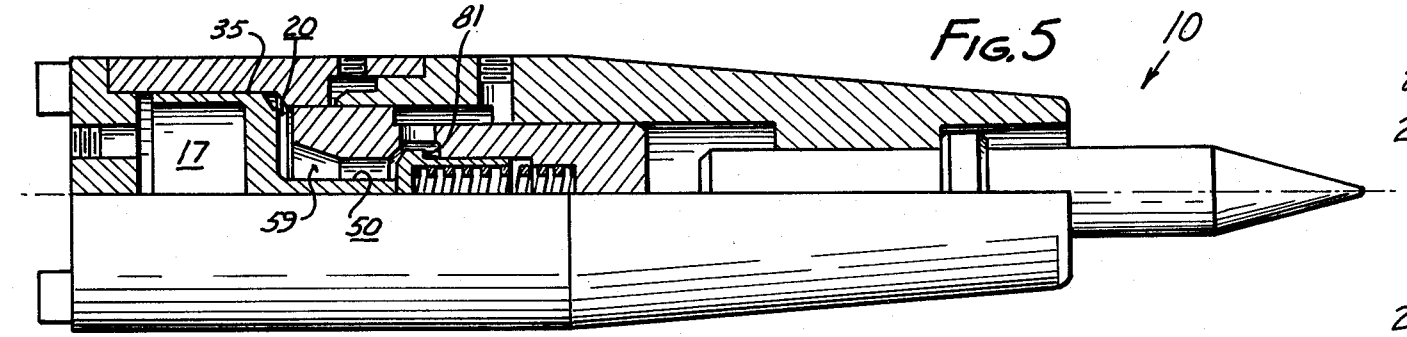

Next, between the positions shown in FIGS. 4 and 5, the poppet will have caught up with and contacted the tip of the probe. This will not have occurred at the most left-hand extreme of possible physical movement of piston 35, because it is undesirable for this piston to bottom out to the left. If piston 35 did bottom out to the left, there would be the possibility of a liquid lock in the storage chamber that would prevent the further advance of the piston head, and the poppet could never reach the tip of the probe. Instead, the tool is designed so that contact will occur at a selected point to produce the desired length of stroke. When the poppet does reach the tip of the probe, it presses against the probe, which resists. The probe moves the poppet off of the seat as a consequence of the greater rate of advance of the piston head relative to the rate of movement of piston 35 away from it. The valve face and valve seat are parted (FIG. 5), and there will be an abrupt equalization of pressure on the left-hand face of the poppet and on the poppet holding face 81. The resulting net force drives the poppet rapidly against the resistance of the spring, abruptly to open the poppet valve. The pressure at the loading face is now suddenly equalized with the pressure in the storage chamber. Because the right-hand end of the piston rod is exposed to atmospheric pressure, there is a net force on the driving member which drives it toward the work tool to exert a blow on it.

During the movement of the piston head to the right on the driving stroke, fluid must transfer across the piston head from the loading chamber to the storage chamber. In many prior art devices, flow of the fluid out of the path of the rapidly moving piston head comprised a serious limitation on its performance and design. However, in this device the flow path is optimally short—it is right through the piston head itself, and through a large number of relatively large dump ports. This device can be constructed so this fluid transfer constitutes only a minor restriction to the movement of the driving member, and this is an important advantage of this invention.

FIG. 6 shows the tool after the driving member has struck the work tool. Piston 35 has exerted its force against the fluid in the storage chamber, and the developed pressure has been exerted against the piston head to drive it to the right. Until the piston head uncovered drain port 65, the storage chamber remained closed to drain. After it passed the drain port, it became open to drain, and this was followed by additional movement of piston 35 to the right as it continued to drive the driving member. FIG. 1 shows the approximate relative positions of piston 35 in its chamber, and of the piston head relative to the drain port at this time. After opening the drain port, the driving member moves through a distance equal to the stand-off distance "Q", and exerts its blow.

After impact, the pressure in the storage chamber and in what remains of the loading chamber is sufficient to hold the poppet in the open position illustrated in FIG. 6. The pressure source may continue to apply pressure at the inlet port if the impact tool is to cycle automatically and deliver sequential blows. There may be some flow through the drain port which is open to flow, because it is not closed by the piston head. However, this drainage will not be unduly wasteful of energy, because the period of time it occurs will be relatively brief. Whether the pressure continues to be exerted or not at the inlet port, the pressure in the storage chamber will approach some value closer to drain pressure than to inlet pressure. The bias spring is designed to be strong enough to displace liquid against this lower pressure. It does so in order to move once again to the closed position shown in FIG. 2, and the cycle will be repeated. If this were a one-shot operation, the supply valve would be used to control the supply of hydraulic fluid on a single actuation basis.

The purpose of providing adjustability of the axial position of the poppet tip as illustrated in FIG. 6 should be evident. Piston 35 slides independently of the poppet, rather than carrying the poppet. It makes more definite and adjustable the axial location where the poppet is unseated. It provides a convenient means for adjusting the energy of the blow. A shorter stroke means less energy delivered.

The operation of the handles and valving means in FIG. 9 are as follows. Either or both of handles 233 and 234 may be pressed down far enough to depress the trigger pin, or the sleeves may be rotated for the same purpose. With pressure on at supply port 68 and with bleed passage 213 closed by point 216, there is a net force pressing the valve shuttle against valve seat 206. There will be no flow through the bypass passage, and all flow will go instead to loading chamber 25, and the impact tool will operate and will continue to operate repetitively so long as the trigger pin closes the bleed passage.

If the handle is released, the net force exerted by the pressure in the bleed passage on the cylindrical tip of the triggering pin moves the triggering pin up and removes the point from the bleed passage, opening up the bleed passage. This dumps the pressure from behind piston 209, and because of the illustrated relative dimensions, there is now a net force on the piston which moves the valve shuttle away from the valve seat and opens the bypass passage to flow from the supply port. This drops the pressure to the loading chamber to one which is insufficient to load the impact tool, and the tool stops. The triggering pin is held up by force on bias face 218. Hydraulic fluid circulates from pressure to exhaust through the bypass passage. However, little energy is lost because there is no substantial pressure drop in the bypass passage.

The trigger pin can be depressed by means other than the handle, but a springy handle is both convenient and comfortable to the user, and he does not have to become directly coupled to the cycling actuator itself. In all other ways, the device of FIG. 9 functions the same as that of FIGS. 1–8.

A few features of this invention merit especial comment. First, it will be noted that the initial volume of the gas chamber is relatively large in comparison to the change in volume of the chamber, which occurs as the pressure in it is raised by compression. The relatively small change in volume, and therefore in pressure change, allows the machine to perform in a more efficient manner than if the compression ratio were greater. A compression ratio on the order of 7:6 or less has been found to be most advantageous. A pressure in chamber 17, at the position of piston 35 shown in FIG. 2, of about 600 psig, and just before the position of FIG. 5 of about 700 psig is suitable. By keeping the pressure drop to a minimum, less heat is generated, which is a great advantage, both as to efficiency and as to comfort of the user.

With reference to FIG. 4, the pressure in the loading chamber acting against the loading face 82 is substantially higher than the pressure which is exerted in storage chamber 20. The ratio of these pressures is inversely proportional to the area of the loading face 82 and the area of the piston rod. The forces on the poppet itself are derived from the hydraulic pressure in the loading chamber operating on the holding face 81 plus the force of the bias spring, which are both opposed by the pressure in the storage chamber acting against that part of the face of the poppet which lies within the sealing line "R", taking into account the vented portion of the poppet stem. The appropriate ratio of the area of the bias face to the said area of the poppet will be selected so the poppet will stay against the seat to close the orifice during loading unless it is physically displaced by the probe. Even as the pressure rises in the loading chamber due to the increased resistance to the motion of the piston rod while it compresses the gas in the gas chamber, the relative magnitudes of the forces maintaining equilibrium of the poppet will stay constant. Thus, energy is stored as the gas in the gas chamber is compressed.

It is also to be observed that the stop 45, the matching shoulder 46 and the skirt 47 form a braking chamber 48, from which the flow of fluid is restricted toward the end of the stroke. This cushions the impact of the piston against the stop.

As design considerations, it is noted that the blow energy obtainable for each stroke is a matter of the length of stroke of the piston, the overall geometry of the machine, and the pressures available for the hydraulic fluid and the gas in the gas chamber. With given hydraulic liquid and gas pressures, energy can be increased by increasing the stroke the piston rod makes before the piston probe makes contact with the poppet. Further, it is evident that the frequency of blows per minute is controlled primarily by the rate of flow made available to the supply port, which can adjustably be varied by valving. Another way to change the energy output is to change the overall scale of the device. Pistons of larger diameter and strokes of greater length means greater energy output for given gas and liquid pressures.

In designing this device, the stand-off distance "Q" is selected so that piston 35 bottoms on its stop before the piston rod strikes the work tool. If this were not so, then there could be a substantial recoil in the system as the consequence of the reaction between the piston rod and work tool while piston 35 continues to drive. The stand-off distance is measured with the piston rod at the position shown in FIG. 1. At this position, the piston rod has just finished uncovering the drain port 65. There remains, however, further driving of the piston rod, because piston 35 will not yet have bottomed out. The dimensions are preferably selected so that, while piston 35 does bottom out before the rod strikes the work tool, further driving of the driving member does occur after drain port 65 is opened. Leakage through the drain port is minor, because of the velocities involved, and most of the energy derived from movement of piston 35 will be delivered to the piston head, even though drain port 65 is open at the time.

In a device to deliver about 1,000 blows per minute at about 125 foot lbs. per blow, with a supply pressure of about 2,000 psi and an initial gas charge of about 600 psi, the following dimensions (in inches) are suitable:

A 4.0 dia.
B 0.60
C 3.0 dia.
D ⅛ hole #91
E 0.060
F 2.5
G 0.98 dia.
H 1.25 dia.
J 0.25
K ½ NPT
L 1.0 dia.
M 2.0 dia.
N 0.75 dia.
P ⅛ hole #95
Q 0.20

The spring constant for the bias spring is about 7 pounds/0.1 inch. It has a 0.75 inch preload to about 52.5 pounds, and is compressed an additional 0.25 inch in operation, to a total bias load of about 70 pounds.

It is evident that the orifice in the head can be located other than centrally, and can be provided in other shapes or numbers of orifices. In each such case, the poppet valve will be modified so as to open and close the orifice to accomplish the sequence as given above. The central arrangement is, however, at once the simplest and most rugged one which is now known to the inventor.

This invention is not to be limited by the embodiments shown in the drawings and described in the description, which are given by way of example and not of limitation, but only in accordance with the scope of the appended claims.

I claim:

1. In a hydraulically-powered impact tool exerting a driving force in only one direction, said tool having an axis, and wherein an axially movable piston makes a fluid-sealing, sliding fit between a variable volume closed gas chamber and a storage chamber, the gas chamber being adapted to receive and contain a compressible charge of gas under pressure, and in which a driving member including a piston head and a piston rod makes a fluid-sealing, sliding fit between said storage chamber and a loading chamber with a driving face facing into said storage chamber and a loading face facing into said loading chamber, the loading chamber being provided with an inlet port to receive hydraulic fluid under pressure, the impact tool being loaded by fluid forced into said loading chamber to move the driving member toward the storage chamber, and thereby causing reduction of volume of the gas chamber and an increased pressure therein, and caused to exert a blow by release of said fluid from the loading chamber to enable the energy of the compressed gas in the gas chamber to drive the driving member through fluid in the storage chamber, the improvement comprising: an orifice extending between the said driving face and loading face, and a poppet carried by the driving member to close said orifice to separate said loading chamber and storage chamber from one another while the impact tool is being loaded, and movable to open said orifice to permit flow of fluid through the orifice from the loading chamber to the storage chamber while the piston head moves toward the loading chamber under force derived from the gas chamber.

2. Apparatus according to claim 1 in which the orifice is centrally formed in said piston head, and the poppet is slidably fitted in the driving member, said orifice, piston head, piston rod, and poppet being coaxial.

3. Apparatus according to claim 2 in which spring bias means biases the poppet toward a position where it will close the orifice.

4. Apparatus according to claim 2 in which a holding face is formed on said poppet exposed to pressure in the loading chamber, the area of said holding face tending to hold the poppet closed while the tool is being loaded in opposition to force exerted on an area of the poppet which is exposed to pressure in the storage chamber.

5. Apparatus according to claim 4 in which spring bias means biases the poppet toward a position where it will close the orifice.

6. Apparatus according to claim 2 in which the orifice and the loading chamber are connected by a plurality of dump ports.

7. Apparatus according to claim 1 in which the storage chamber is provided with a drain port which is closed by the piston head during a portion of its axial movement, and not closed by it during another portion of said axial movement.

8. Apparatus according to claim 1 in which the said chambers are all coaxial and symmetrical around said axis.

9. Apparatus according to claim 1 in which the length and cross section area of the orifice when open are such that they constitute at the most a minor restriction to the movement of the driving member.

10. A hydraulically-powered impact tool having an impact axis along which it imparts a blow, said impact tool comprising:

a. a body, said body having coaxial walls at least partitially defining a respective rod passage, loading chamber, storage chamber, and variable volume gas chamber in that order along the axis;

b. an axially movable piston making a sliding fluid-sealing fit with the wall of the gas chamber and dividing the gas chamber and storage chamber from one another;

c. an axially movable driving member which includes a piston head that separates the loading chamber and the storage chamber from one another, and having a driving face facing into said storage chamber, and a loading face facing into said loading chamber, an orifice formed in said driving member which, when open, enables intercommunication of the driving face and loading face, the driving member also including a piston rod adapted to impart a blow;

d. seal means sealing all of the chambers against fluid leakage therefrom;

e. a valve seat in said orifice;

f. a poppet reciprocably carried by and reciprocable in said driving member, said poppet including a sealing face facing toward said storage chamber and adapted to bear against said valve seat to close the same in a first position and open the same in a second position, and a holding face on said poppet which faces into the loading chamber;

g. bias means biasing the poppet toward its first position;

h. an inlet port opening through the body into the loading chamber; and i. a probe facing the poppet mounted and disposed so as to restrain the poppet against axial movement at some axial location of the driving member, whereby to remove the poppet from the valve seat to enable the driving member to be driven.

11. Apparatus according to claim 10 in which the orifice is centrally formed in said piston head, and the poppet is slidably fitted in the driving member, said orifice, piston head, piston rod, and poppet being coaxial.

12. Apparatus according to claim 11 in which the bias means comprises a spring.

13. Apparatus according to claim 11 in which the area of said holding face is sufficient to hold the poppet closed while the tool is being loaded in opposition to force exerted on an area of the poppet which is exposed to pressure in the storage chamber.

14. Apparatus according to claim 13 in which the bias means comprises a spring.

15. Apparatus according to claim 11 in which the orifice and the loading chamber are connected by a plurality of dump ports.

16. Apparatus according to claim 10 in which the storage chamber is provided with a drain port which is closed by the piston head during a portion of its axial movement, and not closed by it during another portion of said axial movement.

17. Apparatus according to claim 10 in which the said chambers are all coaxial and symmetrical around said axis.

18. Apparatus according to claim 10 in which the length and cross-section area of the orifice when open are such that they constitute at the most a minor restriction to the movement of the driving member.

19. Apparatus according to claim 10 in which valving means is provided adapted to control flow of hydraulic fluid to the loading chamber, and means to select the control positions of the valving means.

20. Apparatus according to claim 19 in which the valving means comprises a bypass passage between the drain port and a supply port which loads the loading chamber, and a valve shuttle adapted to open the bypass passage to flow whereby to stop the tool, and to close it to flow to operate the tool.

21. Apparatus according to claim 20 in which the valve shuttle carries a valve seal to close the bypass passage, a piston to fit in a cylinder with a clearance between the piston and the cylinder, a bleed passage through the valve shuttle interconnecting the cylinder and the bypass passage, and a reciprocable trigger pin adapted to close or to leave open the said bleed passage to cause the valve shuttle to close or to leave open the bypass passage.

22. Apparatus according to claim 21 in which the trigger pin is force-biased away from the valve shuttle.

23. Apparatus according to claim 21 in which a spring-like handle attached to the body of the impact tool is adpated to be pressed against the trigger pin to cause it to close the said bleed passage said handle movement being axial.

24. In combination: an impact tool according to claim 10, and a handle attached to the body thereof having a pair of springy ends which are axially movable.

25. A combination according to claim 24 in which each said end is a U-shaped bend, with only one leg thereof attached to the body.

26. A combination according to claim 25 in which said handle can be depressed to actuate a valving means to run the impact tool.

27. A combination according to claim 25 in which the valving means comprises a bypass passage between the drain port and a supply port which loads the loading chamber, and a valve shuttle adapted to open the bypass passage to flow whereby to stop the tool, and to close it to flow to operate the tool.

28. Apparatus according to claim 10 in which the piston and the body form between them a braking chamber with a restricted exit therefrom to decelerate the piston toward the end of its travel toward the driving member.

29. Apparatus according to claim 10 in which the probe is adjustably mounted to the body and passes through the piston, whereby the location where it restrains the poppet can be selected.

30. Apparatus according to claim 10 in which the probe is carried by the piston.

31. Apparatus according to claim 1 in which a probe is disposed in the storage chamber to unseat the poppet and open the orifice at some axial position of the driving member.

32. Apparatus according to claim 31 in which the axial location of the probe is adjustable.

33. Apparatus according to claim 31 in which the probe is carried by the piston.

34. In combination: an impact tool of the class which delivers repetitive axial blows, said impact tool including a body; handle means for manipulating the tool so as to orient and press it in a desired axial direction, said handle means comprising: a pair of U-shaped handles made from flat springy material each projecting from an opposite side of the body, with one leg of each attached to the other to form a cross member, and the other leg attached to the body, the flat springy material being flexible in the direction of the axial blows, and resistant to flexure normal to said axial blows; valving means carried by the body, a trigger pin forming part of the valving means, said trigger pin being biased toward the cross member, the bias being overcome by sufficient force exerted against the trigger pin by the cross member whereby to depress the valving means to permit flow of pressurized fluid to operate the impact tool; and a non-circular rotatable element which surrounds at least one of said handles, whereby when turned to one position the trigger pin is pressed, and in another position is not.

* * * * *